US005316279A

United States Patent [19]

Corona et al.

[11] Patent Number: 5,316,279

[45] Date of Patent: May 31, 1994

[54] COPIER/PRINTER JOB STACKING WITH DISCRETE COVER SHEETS WITH EXTENDING PRINTED BANNERS

[75] Inventors: Stephen C. Corona; Elizabeth D. Fox; Norman D. Robinson, Jr., all of Rochester, N.Y.

[73] Assignee: Xerox Corporation, Stamford, Conn.

[21] Appl. No.: 79

[22] Filed: Jan. 4, 1993

[51] Int. Cl.[5] ..... B41F 13/54; B65H 33/04; B65H 3/44

[52] U.S. Cl. ..... 270/1.1; 270/95; 271/9; 355/311; 355/325

[58] Field of Search ..... 270/1.1, 58, 95; 355/321, 322, 323, 311, 325; 271/9

[56] References Cited

U.S. PATENT DOCUMENTS

| | | | |
|---|---|---|---|
| 3,946,879 | 3/1976 | Jensen | 270/58 X |
| 4,602,775 | 7/1986 | Calhoun et al. . | |
| 4,602,776 | 7/1986 | York et al. . | |
| 4,681,428 | 7/1987 | Devoy . | |
| 4,763,161 | 8/1988 | Forest et al. . | |
| 4,777,510 | 10/1988 | Russell . | |
| 4,826,147 | 5/1989 | Shino et al. . | |
| 4,970,554 | 11/1990 | Rourke . | |
| 4,974,035 | 11/1990 | Rabb et al. . | |
| 4,987,447 | 1/1991 | Ojha . | |
| 5,037,081 | 8/1991 | Engelhardt et al. | 271/207 |
| 5,079,598 | 1/1992 | Kaneko et al. | 355/309 |
| 5,098,074 | 3/1992 | Mandel et al. | 270/53 |
| 5,124,731 | 6/1992 | Knodt et al. | 355/319 X |
| 5,128,761 | 7/1992 | Muramatsu et al. . | |
| 5,177,548 | 1/1993 | Nakamura et al. | 355/311 X |
| 5,217,217 | 6/1993 | Matsumoto | 271/9 |
| 5,245,397 | 9/1993 | Mahoney | 355/325 |

FOREIGN PATENT DOCUMENTS

| | | | |
|---|---|---|---|
| 185675 | 8/1987 | Japan | 355/311 |

*Primary Examiner*—Edward K. Look
*Assistant Examiner*—John Ryznic

[57] ABSTRACT

An improved system for segregating and identifying separate job sets from a commonly stacked output of plural job sets of copy sheets sequentially generated by a printer and sequentially outputted into a sheet stacker in which they may be superposed commonly stacked. A control system selects which standard size sheet supply tray of the printer will feed the copy sheets for a selected job set, and can automatically feed and print a cover sheet of a larger size or different orientation before or after the job set copy sheets are fed. The sheet stacker may desirably stack the copy sheets of the job sets commonly edge aligned but so that at least one edge area of the cover sheets extends substantially from at least one edge of the stack of copy sheets of the job sets to provide an exposed printed banner strip for clear job sets segregation and separation even if the commonly stacked plural job sets of copy sheets are misaligned in subsequent handling. The cover sheets may be printed side up even if the job set copy sheets are stacked printed side down. The exposed banner strip may have identifying indicia printed thereon for identifying job sets.

13 Claims, 4 Drawing Sheets

COPIER/PRINTER JOB STACKING WITH DISCRETE COVER SHEETS WITH EXTENDING PRINTED BANNERS

The disclosed system provides improved sequential output stacking separation and identification of multiple sheets, such as multiple sets or jobs of copy sheets outputted by a copier or printer, with improved individual job set identification and separation for subsequent handling, particularly for large stacks of commonly stacked jobs, with little or no increase in cost or interference with normal stacking.

As shown in the disclosed examples, this may be provided by utilizing automatically generated job separating and identifying cover sheets which extend substantially in at least one dimension from the edge of the rest of the job stack itself. As shown, these extending cover sheets may be generated simply by feeding and banner printing a larger sized or differently oriented standard paper size sheet already available in the machine, and providing an appropriate stacking system for the job sets and their extending cover sheets.

The disclosed system may be effectively utilized as part of an overall system for job set compiling, set separation, and set distribution, in which job sets of plural individual copy sheets are compiled and "segregated" into discrete job sets, having good set separation integrity even through commonly stacked with other such job sets, yet without requiring set binding, such as stapling or gluing.

The disclosed sheet output stacking and job separation system has particular utility or application for improved stacking of pre-collated copy output sheet sets from a copier or printer into an output stacker (which may encompass finisher compilers). Particularly, in stacking large numbers of completed copy sets in a high-capacity stacker, especially, a moving tray stacker (a tray repositioning, resetting or tray elevator stacker). Such stacked copy sets may be unfinished, (loose) or may be stapled, glued, bound, or otherwise finished. They may also offset from one another, unfinished. However, the present system eliminates the normal need for alternatively offsetting unfinished, commonly stacked jobs, by providing a better system of distinguishing and separating commonly stacked jobs.

High-capacity stackers are particularly desirable for the collected output of high speed or plural job batching copiers or printers. High capacity stackers with clear job distinctions are particularly desirable for accumulated output of unattended shared or plural user (networked) printers, of any speed, or plural document job set "batching" stackers.

It is well known in the art to be desirable to provide a sheet stacking system with a stack elevator so that the stacking tray is maintained at a suitable level and angle for such stacking, but so that the stacking tray is moved downwardly vertically as the stack accumulates (builds up), so that the top of the stack remains in the same general relative position below the sheet output. Some examples of prior patents disclosing high-capacity stackers include Xerox Corporation U.S. Pat. No. 5,098,074, issued Mar. 24, 1992 to the same Barry P. Mandel, et al., and Eastman Kodak Company U.S. Pat. No. 5,026,034, issued Jun. 25, 1992 to Steven M. Russel, et al.; and art cited therein. An integral or modularly related copy set compiler and stapler or other finisher can also be provided, as disclosed in said same U.S. Pat. No. 5,098,074, and art therein.

Various general problems of sheet restacking, especially the settling of an ejected sheet onto the top of the stack, are well known in the art in general. Some examples of various output restacking assisting devices are taught in Xerox Corporation U.S. Pat. Nos. 4,469,319; 5,005,821; 5,014,976; 5,014,977; 5,033,731; and art therein.

The problem of keeping shared (networked) printer job outputs from becoming mixed up, or accidentally removed by others, is serious enough that some users have for several years placed manual mailboxes, like Post Office boxes, adjacent the printer, with the boxes labeled with different user names, for manual job sorting. Likewise, for shared hard copy facsimile machines. This is in spite of the fact that cover sheets are automatically generated and placed on top of each separate job set in many printer output stacking systems, and lateral offsetting (side shifting) of each job relative to the next is also commonly used together therewith. However, offsetting requires special output or tray shifting mechanisms, and can interfere with side tamping or other set edge registration systems. Also, quite often the offset sets become scrambled before or during operator job removals, even if set offsetting was done properly to begin with. One prior art job offsetting stacking system is shown in Xerox Corporation U.S. Pat. No. 4,431,177 to Beery, et al.

In modern copiers or printers, cover or slip sheets or other inserts may be automatically added to sets, subsets or chapters by the copier or printer itself feeding the cover stock or other slip sheet from separate supply stacks at the correct times to be automatically interleaved with the normal sequential output of copy sheets, with or without printing thereon. The Xerox "5090", Kodak, and other copiers or printers can automatically insert colored covers. See also allowed Xerox Corporation U.S. Ser. No. 07/796,524, filed Nov. 22, 1991 by R. A. Coons, et al., on a Z-folded larger sheet inserter for insertions into copy sets, and inserter art therein. Automatic selectable cover sheet or tab sheet inserter systems, feeding these special sheets from separate paper feeding trays into job sets are taught, for example, in Xerox Corporation U.S. Pat. No. 4,974,035 issued Nov. 27, 1990 to K. M. Rabb, et al., or Eastman Kodak U.S. Pat. Nos. 4,777,510 or 4,763,161. However, tab insert sheets are normally for inserts internal of job sets, and they require expensive specially cut heavy paper stock, which presents feeding difficulties, especially from the partial or uneven tabbed edge. Sheet stacks with some sort of colored separator marker strips or sheets which are manually inserted to stick out of the stack are sometimes used in copy shops.

Further by way of background, unbound sets of copy sheets are difficult to keep tidy and sort or separate from each other. As noted above, it is fairly common for copiers and printers to provide relative offsetting of sequential unbound copy sets which are otherwise being commonly stacked, so as to facilitate separation and sorting, but it has been noted that such copy set offsetting is easily disturbed even during stacking, and especially during set unloading. Lateral edge jogging of the offsets os difficult, if not impossible, so that the two offset sides of the stack are often poorly aligned or registered. There is often no fixed registration wall holding the stack edge in the offset movement axis before or after stacking. Also, set offsetting interferes with the transporting and distributing of the common stack of plural offset sets. I.e., the integrity of individual unbound set stacks is easily disturbed during handling. Suitable trays or containers designed for standard sized sheets may not accommodate the additional dimensions needed to the accommodate the offset sheets.

As noted, a particular problem is that modern printers, copiers, fax machines and workstation terminals are now more and more utilized as shared and/or integrated components of overall office systems, in which they are cost-effectively shared by plural users, electronically and/or physically. Loose sheets of paper in an output tray, sorter bins, or mailboxes of the printer/copier/fax generated by different system users, or different jobs, are not easily sorted into separate sets for convenient delivery to those system users or their intended recipients. Merely offsetting copy sets (with alternating different side registration positions), or even inserting colored paper slip sheets or the like between sets, has not been found to be particularly effective in maintaining said set separation, and does not maintain set integrity. Removal of one or all of merely offset stacked sets frequently fans, jumbles or otherwise intermingles pages and sets together and requires subsequent tedious manual sheet separations. Throw-away cover or insert slip sheets between each job set are material wasteful, and some colored paper stocks even cause paper recycling difficulties.

Further by way of background, as xerographic and other copiers and printers increase in speed, and become more automatic, it is increasingly important to provide higher speed, more reliable and more automatic handling of the copy sheets being copied or printed, i.e., the rapidly accumulating output of the copier or printer. Thus, it is even more important to better segregate separate sets of output copies, even if the copier or printer is a stand-alone unit rather than a network sharing unit.

The term "printer" as used herein encompasses various copiers, printers, facsimile receivers and various combinations thereof. Plural sheets in a desired ultimate associated stack are referred to herein as a "set" or "job". Normally, desirably, a plural copy sheet (copies) set or job is outputted and maintained in collated or related page order [even though no physical page number may be present]. This is normally the same page order, or the reverse order, in which the original documents or electronic page images were copied.

The present system "packages" stacked sets or jobs of sheets in such a way that the individual job sets are clearly distinguishable from one another even though otherwise commonly stacked, and unbound, without requiring job set offsetting, and without requiring expensive or difficult to feed special sheets. In the present system, sets are readily stacked with proper alignments, readily separately identified and removed, and set integrity is much more easily maintained during removal and other handling.

Furthermore, another disclosed feature herein is provide useful set identification which is external of the job set itself in exposed edge areas of the cover sheets. Yet, that can be done with existing printing and marking indicia, if desired. This can aid in set identification, separation, distribution and/or filing operations.

If desired, such clearly externally exposed job set and/or job author identification indicia printed on physical extending banners can also allow time consuming manual office functions to be at least partially automated. For example, allowing the job cover sheet indicia to be read by known bar code or other indicia readers, and/or automatic mailing and distribution and/or filing systems controlled by such indicia readers. I.e., a bar coding or other user unique (and/or job unique) set identifier can be automatically printed onto the cover sheet exposed banner strip. This may be done by the printer itself. Alternatively, it may be done by an ink jet, thermal, or other tape printer (e.g., as in fax or supermarket printers) in, and/or in electronic communication with, the printer or copier printing the job sheet set.

That is, the present system can additionally provide the further function of providing useful job set and user identity identification by the use of specially printed words, numbers, bar codes, colors, aperture patterns, or other marking indicia. Otherwise commonly batched plural sets may readily delineated from one another by indicia which is readily visible extending from the edges of the stacks, i.e., without requiring lifting up or sorting through the pile of common stacking job sets, and without requiring offsetting. Thus, desirably, multiple job sets and/or shared jobs from different systems users can be collected in simple common output trays, and/or fed into boxes or containers corresponding to the dimensions of standard copy sheets, with all of the sets neatly stacked therein to the same edge alignment, without confusion between the sets, and with each separate set being readily manually or even machine blade removable without disturbing the sheets of adjacent or other sets, and with clear visual alphanumeric set identification and/or machine readability.

By way of background art in that regard as to bar code job identifier printing or sheet insertion controls in a copier or printer, there is noted Xerox Corporation York et al U.S. Pat. No. 4,602,776, and particularly Rourke U.S. Pat. No. 4,970,554, and also Rourke et al U.S. Pat. No. 4,757,348 and Eastman Kodak U.S. Pat. No. 4,987,447. The latter particularly relate to printing job control sheets in the printer itself-bar code printed copy sheets.

Disclosed in the embodiment hereinbelow, is an improved system for segregating, identifying and separating separate job sets of copy sheets from a commonly stacked output of plural job sets of copy sheets and cover sheets therefor which are sequentially generated by a printer, wherein the copy sheets are sequentially outputted into a sheet stacker in which the plural job sets of copy sheets and their cover sheets may be superposed commonly stacked; and wherein the printer has at least two separate sheet supply trays for the selective feeding of at least two standard sizes of copy sheets for printing; comprising: control means for selecting which said sheet supply tray will feed copy sheets for a selected job set and for a cover sheet for said job set; said control means automatically repeatedly feeding and printing a cover sheet for a job set from a said sheet supply tray which is different from the said paper sheet supply tray from which said job set copy sheets are fed; said sheet stacker being adapted to commonly stack said plural job sets of copy sheets and said respective cover sheets therefor commonly edge aligned on at least two edges, but with at least one edge area of said cover sheets for said job sets extends substantially from at least one edge of said stack of copy sheets of job sets to provide an exposed extended edge banner strip which provides job set segregation and separation by being easily visible and graspable even if said stack of plural job sets is subsequently misaligned.

Other specifically disclosed features, individually or in combination, include said sheet supply tray from which said cover sheets are fed containing a larger standard paper size than said sheet supply tray from which said job set copy sheets are fed, and/or wherein said sheet supply tray from which said cover sheets are fed contains standard legal size sheets, and wherein said sheet supply tray from which said job set copy sheets are fed contains standard letter size sheets, and/or wherein said sheet supply tray from which said cover sheets are fed contains a differently oriented standard paper size than the sheet supply tray from which said job set copy sheets are fed, and/or wherein said sheet stacker includes stacking registration means providing sheet stacking edge alignment in said sheet stacker of at least one edge of said job sets other than said at least one edge from which said cover sheets extend, and/or wherein said stacker is a two-axes corner stacker with a stacking surface and two edge registration surfaces substantially perpendicular said stacking surface for edge alignment of both said job set copy sheets and said cover sheets to said two edge registration surfaces, and/or wherein said stacker provides unobstructed stacking space on said stacking surface on at least one of the sides thereof opposite from said two edge registration stacking surfaces for said extended edge areas of said cover sheets, and/or wherein said stacking surface inclines downwardly from the horizontal on both axes towards both said registration surfaces to provide gravity corner stacking, and/or wherein said printer and said control means are further adapted to print job set identifying indicia on said edge area banner of said cover sheet which extends from said job set of copy sheets in said sheet stacker, before said cover sheets are outputted to said stacker, and/or wherein said job set identifying indicia on said extending edge area banner includes indicia indicating the generator of the directly adjacent job set in the common stack of plural job sets in the sheet stacker, and/or wherein said cover sheets are at least partially perforated along a tear-off line, which tear-off line is positioned so that said extended edge banner portion can be torn off leaving the remaining portion of the cover sheet with the same dimensions as said job set copy sheets, and/or wherein said cover sheet is printed in both said removable extending edge portion banner and said remaining portion, and/or wherein said remaining portion is printed with job set text to form part of said job set, and/or wherein at least one tear-off mailing label is printed on said extended edge banner portion, and/or wherein said job set copy sheets are stacked printed side down in said sheet stacker and wherein said cover sheets are stacked with said printed side up in said sheet stacker.

All references cited in this specification, and their references, are incorporated by reference herein where appropriate for appropriate teachings of additional or alternative details, features, and/or technical background.

As to specific hardware and/or software components which may be used with the subject apparatus, or alternatives, it will be appreciated that, as is normally the case, various suitable such specific hardware components are known per se in other apparatuses or applications, including the cited references and commercial applications thereof.

Various of the above-mentioned and further features and advantages will be apparent from the specific apparatus and its operation described in the example below, as well as the claims. Thus, the present invention will be better understood from this description of embodiments thereof, including the drawing figures (approximately to scale) wherein:

Figure 1:
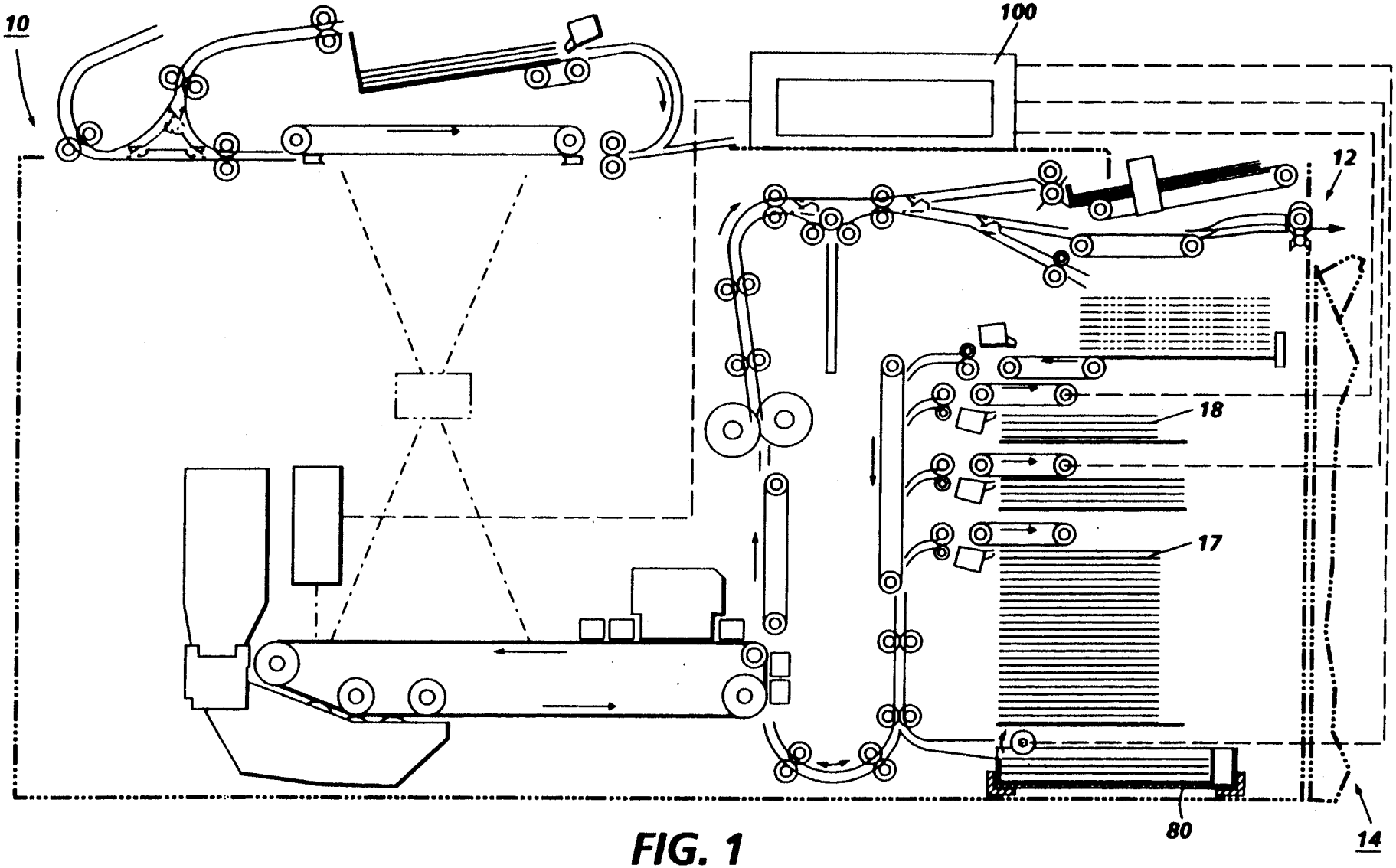
FIG. 1 is a schematic front view of one exemplary copier/printer incorporating two examples of the disclosed job set separation and identification system.

The present invention is not limited to the specific embodiment illustrated herein. Referring first to FIG. 1, there is shown merely one example of copier/laser-printer 10, for electronic and/or physical document input in this case, with a sheet 11 output 12 to a sheet receiving and stacking system 14. There is provided common output 12 sheet 11 stacking in job sets 13 with improved separation and control by cover sheets 15 and/or 16 overlapping and extending from each desired job set 13, as will be further described [see especially FIG. 4].

Figure 2:
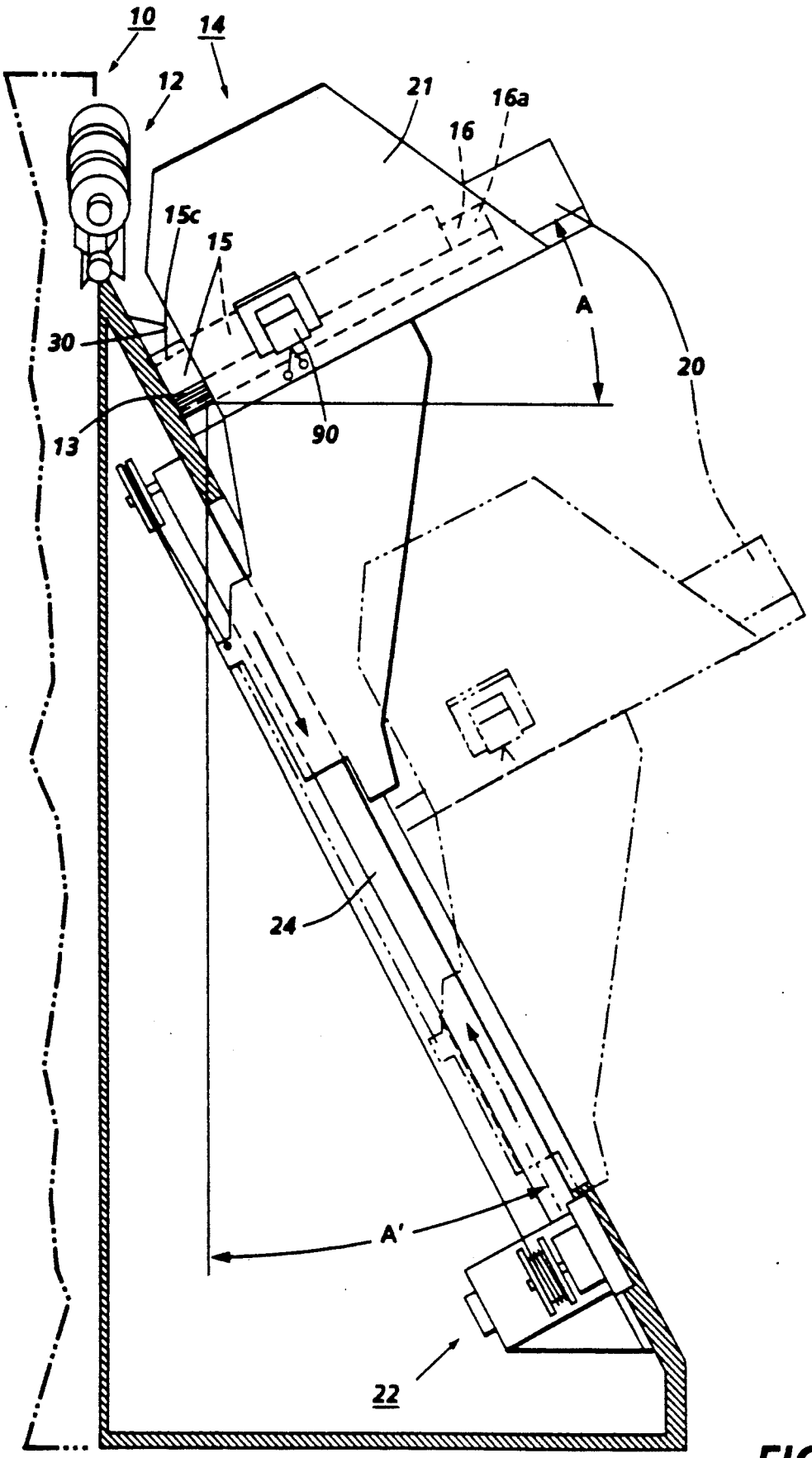
FIG. 2 is a schematic enlarged rear view of one exemplary copy sheet output system, for the copier/printer output of FIG. 1, incorporating one example of a suitable job stacking and job segregating system. [This embodiment utilizes a non-vertical tray elevator and a stacking tray with two axis sloped (corner) stacking]
Figure 3:
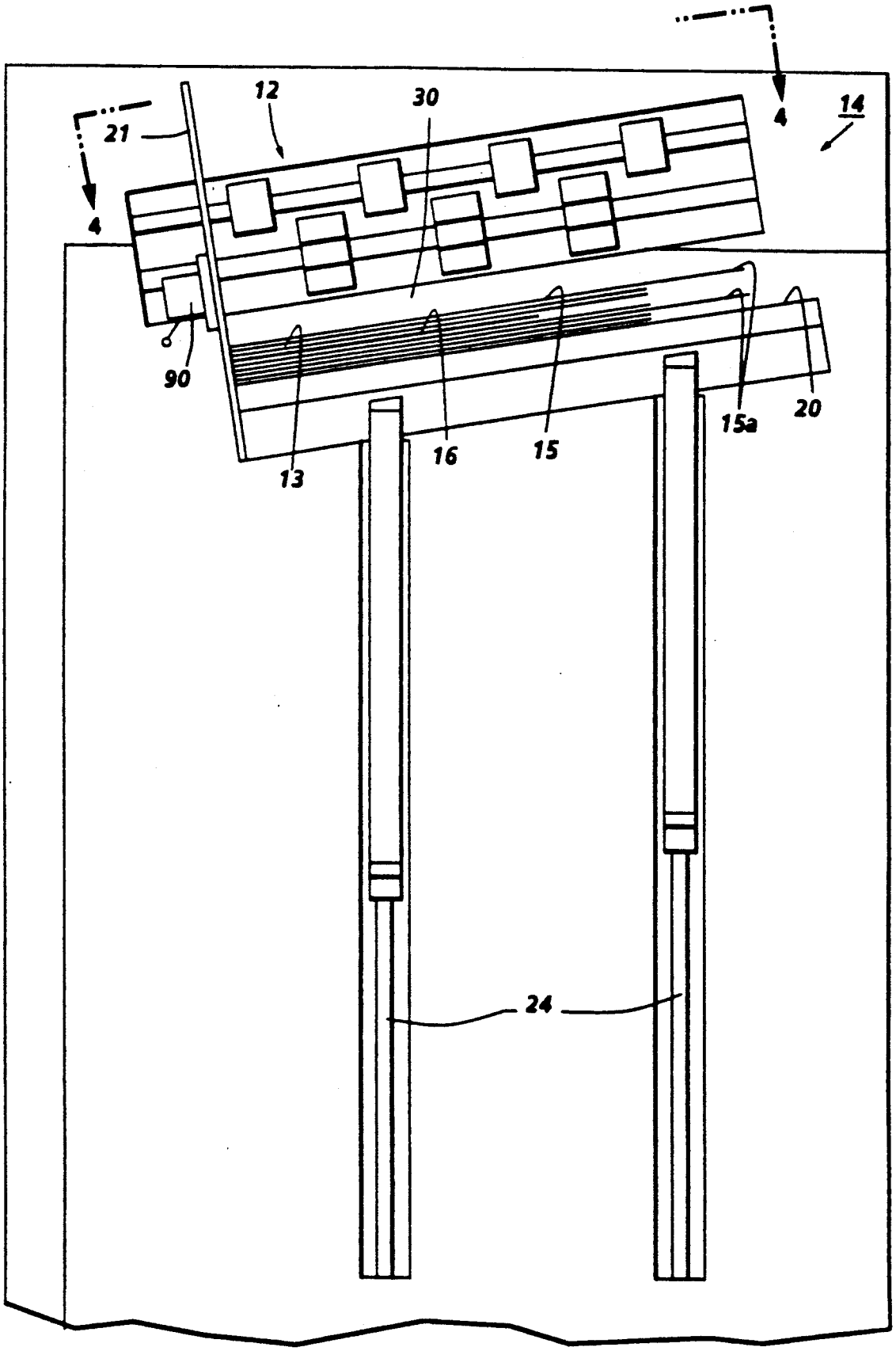
FIG. 3 is an end view of the job stacking and segregating system of FIG. 2.
Figure 4:
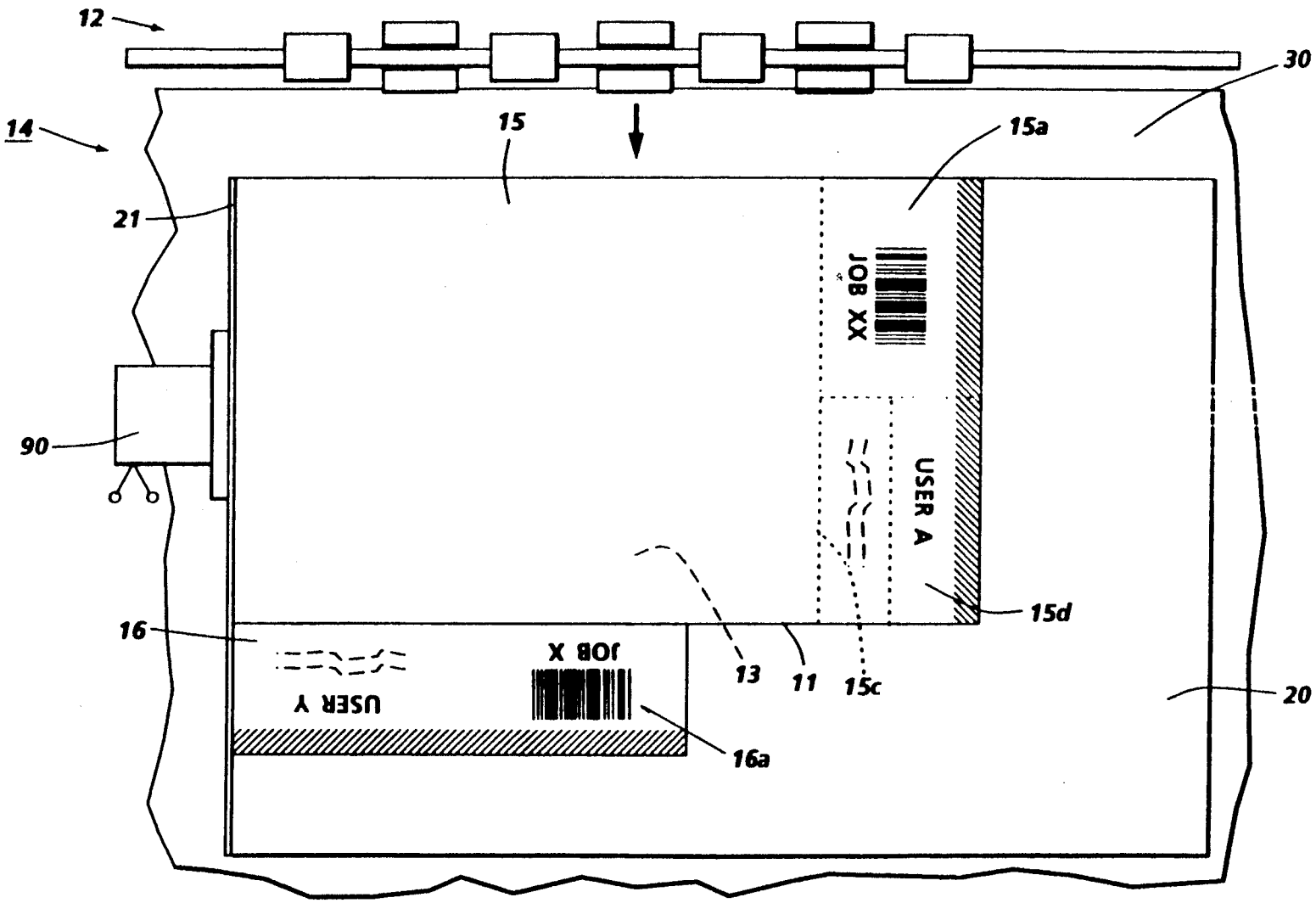
FIG. 4 is a top view thereof.

There is shown in this example in FIGS. 2–4 a high-capacity elevator-type stacking tray system 14, closely adjacent the sheet output 12 feeding nips, for being fed sheets for stacking. Although preferably an integral or modular component of a reproduction apparatus such as 10, the stacking system 14 may also be a self-contained, stand-alone unit, wheeled up to and docked with any reproduction apparatus, when desired. The present system can be used with many different sheet output stacking systems, although a system such as 14 here, providing lateral sheet stacking alignment to one side rather than both sides (as well as set alignment in the process direction) is desired.

The disclosed concept provides a more effective alternative for the standard cover sheets used to identity and distinguish printer jobs 13. Such normal cover sheets are normally of the same size and orientation as the job sheets 11 themselves. That is, printer job cover sheets are ordinarily printed on the same standard, e.g., letter size, paper as the job itself, and thus easily missed in a common stack of plural jobs. Here, the cover sheets 15 are instead printed on the next larger paper size in the machine which larger in one dimension, e.g., legal size, so as to extend in that one dimension when stacked with the job sets. Since, however, legal size has the same width (narrow dimension) as letter size, it may be desirably commonly registered with the job sheets in that common dimension.

Also, here job identifying information is printed on the extending dimensional area of the cover sheets, referred to here as the banner 15*a*. For cover sheets 15, the banner 15*a* is the 3 inch (7.62 cm) end area 15*a* of the 14 inch (35.5 cm) sheet, which will extend outside of the job stack of letter size sheets, which are 8.5×11 inches (21.5×28 cm) [see especially, FIG. 4]. This banner portion 15*a* of the cover sheet 15 extending from the job stacks 13 provides highly visible, graspable, and identifiable cover or job separator sheets.

Additionally, if desired, the cover sheets 15 may be perforated at (across) the 11 inch (28 cm) extension line position 15*c*, so that upon receipt of the job set, the customer may tear off only this extending banner 15*a* and discard it, reducing paper waste by 70% compared to the present practice of discarding the entire cover sheet. That is, if it is desired to keep the cover sheets 15 after the removal of the job sets 13 from tray 20, or even to employ the cover sheet 15 as the first page of the text of the job set, this can be readily accomplished by loading paper into tray 18 which is perforated or slit along line 15*c* so that banner 15*a* can be simply torn off along that line 15*c* to leave the rest of the cover sheet 15 the same size as the job sheets 11. Or, a (partial) sheet slitter can be provided therefor in the sheet output 12 or upstream thereof. Duplicate identifying indicia can be printed on both parts.

The extending edge area 15*a* or 16*a* of the cover sheet 15 or 16 may also optionally be provided with one or more printed address labels such as 15*d* shown in FIG. 4. These labels areas 15*d* may be provided with additional burst or tear lines, like 15*c*. This is a further utility for the banner edge area 15*a* or 16*a*, additionally printed at no additional cost by the printer 10 on the same cover sheets.

It is very important to note that here the cover sheets 15 may be provided for normal, letter size paper job runs simply by changing the paper supply feeding (for only the job separator sheets) from that letter sheet supply tray 17 to the next larger conventional (existing) paper supply 18 in the copier or printer 10. I.e., to the paper supply 18 which such machines 10 would already normally have loaded with legal size or other larger sheets. Thus, no special paper loading is required for the cover sheets.

Likewise, without any new hardware or operator steps, the same printer 10 in this system may also print an identifying job banner on the end part 15*a* of the cover sheet which will extent exposed from the edge of the output stack of multiple collated jobs of normal sized (e.g., letter) paper 11, as shown in FIG. 4. The job set identifying indicia printed onto the cover sheets can include either or both a printer-user (job generator) identifier and a specific job identifier, such as the subject title and/or date and/or job number of the document, and/or the number of pages, and/or the number of copy sets being made, etc.

In the embodiment here, the stacking tray system 14 has a stacking tray 20 sloping on 2 axes so that one side edge registration wall 21 provides gravity 2-axes or "corner" stacking to one side of the process path as well as in the process direction. Process direction set stacking registration is provided by registration wall 30 here.

An additionally (optional and/or alternative) disclosed feature here is a two-way or reversible paper tray or cassette 80 in machine 10 which allows sheets to be fed either short edge or long edge first into the copier or printer 10. This allows the same size sheet to be fed, but fed at 90° to the job sheets 11, as a cover sheet 16 for job sheets to provide the desired printable banner extension 16*a* of the cover sheet 16 from the job set 13. In this case, the edge extension is in the process direction. The job sheets 11 are desirably normally fed and printed long edge first [portrait mode] for maximum machine 10 productivity, whereas the cover sheet 16 therefor is fed and printed short edge first [landscape mode or lengthwise] [See especially, FIGS. 3 and 4]. Also shown as an additional option are such same-size, but 90° rotated, job sheets 16 intermixed with larger size job sheets 14 of the normal machine sheet orientation, as previously described. One example of a rotatable or two-way mounting paper cassette 80 is disclosed in U.S. Pat. No. 4,826,147, issued May 2, 1989.

To summarize, for the larger-size cover sheets 15 here, job cover sheet heretofore printed on job size paper 11 is instead printed on the next larger standard size sheet 15 (one normally also already loaded in the printer). Cover sheet job information ordinarily only printed centrally on the cover sheet 15 (or 16) is printed at the extending banner border area 15*a* or 16*a*. That banner is on a side of the cover sheet 15 (or 16) which is not registered to side registration wall 21 or end registration wall 30. Accordingly, it may be seen that integration of this system to normal stack compiling and even finishing can be easily implemented by software changes in a printer with no incremental machine cost. This also eliminates the need for alternative job set offsetting of unfinished sets, which creates stacking and other problems. An extending, graspable, and identifiable cover or job separator sheet area 15*a* or 16*a* indicating the separate job under that cover sheet 15 or 16 is thus automatically provided. Each job sheet 15 or 16 extends substantially exposed from the edge of the output stack of multiple jobs. Even if the stacked job sets are subsequently fanned, skewed or otherwise subsequently misaligned, these extending edge banners will still clearly separate the individual jobs.

The exemplary stacking system 14 here provides an otherwise conventionally movable tray stacking unit, with the stacking tray 20 providing a stacking surface, mounted in a movable elevator system 22 to be moved on an elevator track 24. This provides a repositionable but constantly inclined floor or stacking surface for the accumulating stack of sheets in the stacking unit 14. The stacking tray 20 moves linearly, but non-vertically, (at angle "A'") to maintain a desired, fixed stacking angle of inclination "A". This is further described in copending, commonly assigned, U.S. Ser. No. 07/888,066 filed May 26, 1992, by Barry P. Mandel.

As described there, the tray elevator system 22 may be controlled by a conventional stack height sensor to maintain the top of the stack at an approximately constant level, and in the same relative position to the printer 10 copy sheet output 12, (the input to tray 20) as is well known, and described in the art. This stacking tray 20 automatic elevator 22 repositioning as the stack accumulates is illustrated by the associated movement arrow. The same controller 100 may be used. Various suitable elevator drive or movement mechanisms are known and/or shown in the art, including the EK U.S. Pat. No. 5,026,034, FIG. 2. It may be a known stepper motor and cable drive, or a ratchet, lead screw, or parallelogram linkage drive, or other suitable tray elevator mechanism. A particular similarly illustrated elevator drive system is already shown and described in Xerox Corporation U.S. Pat. No. 5,098,074 by Barry P. Mandel, in Columns 5–6, inter alia, and need not be described in detail herein.

As best seen in FIG. 2, the specific exemplary embodiment disclosed herein has a stacking tray 20 with an inclined stacking surface at a desired gravity stacking angle "A" to the horizontal in the process direction. The tray 20 stacking surface is also inclined orthogonally towards the side registration wall 21, at best seen in FIG. 3. The stacking system 14 here has a sheet stacking registration wall 30 at the lower and inside end of the stacking surface which is perpendicular to (at 90° to), the tray 20 stacking surface. This stacking tray 20 is part of an integral tray unit movably mounted on the tray elevator tracks 24 and movable by the tray elevator system 22 to maintain the tray angle "A" orientation. The tray elevator system 22 is able to move tray 20 here downwardly but also outwardly, in a linear path which is at a minor acute angle "A'" from the vertical. This non-vertical elevator track 24 angle "A'" here is at the same angle as the stacking registration wall 30, which allows the fixed elevator track 24 or, preferably, the fixed end wall 30 of the stacker system 14 (or the copier or printer) to provide the process direction or rear side stacking registration and yet be desirably maintained perpendicular to the stacking surface of tray 20 at all times.

This elevator track angle and surface 30 angle "A'" is also substantially equal to the angle "A" that the tray 20 surface is inclined from the horizontal. Thus, output stacking registration of copy sheets is provided by the desired angle "A" providing an inclined or sloping surface for edge registration assistance by gravity encouraging the incoming sheet to slide down on top of the inclined stack of prior sheets, down against the registration wall 30. That is, the tray 20 stacking slope is inclined downwardly back towards the sheet output 12, and downhill towards registration wall 30, to provide "uphill stacking" relative to the sheet entrance direction from output 12 of printer 10. [The other, orthogonal, slope towards wall 21 may be at approximately the same angle "A", or whatever angle is suitable for the same function.]

In the disclosed stacking system, such a desirable initial stacking angle "A" is compatibly combined with correctly, fully aligned, set stacking relative to all previously stacked sets by the compatible non-vertical perpendicular movement along the line of the matching angle "A'" of the stacking tray 20 for cumulative stacking, and with the registration wall 30 constantly at the same angle "A'". Thus, the registration wall 30 is always perpendicular the tray 20 stacking surface. Thus, all sheets of the completed stack are evenly aligned and squarely superposed with one another irrespective of stack height.

To express it another way, in the exemplary stacking system 14 shown herein, the output stacking elevator lowers with stack accumulation in a non-vertical direction at angle "A'" which is parallel wall 30 and perpendicular tray 20 which is at angle "A". Because of this, the resulting stack accumulating against both surfaces can be made perfectly square.

As an optional feature, especially if there is no tray elevator stack height sensor control, the control logic in the controller 100 can be used with a tray sheet entrance counting switch to count the total number of outputted 12 sheets since the tray was last emptied, to provide an approximate determination of the stack height, and provide corresponding control signals in response thereto. These may be fed here to the control for the stepper motor or other elevator 22 drive to effect a corresponding change in tray 20 height.

For another optional feature, an integral or related copy set stapler of or other finisher can be provided prior to stacking, as disclosed in said U.S. Pat. No. 5,098,074, issued Mar. 24, 1992 by Barry P. Mandel, et al., for example. In that case, the tray 20 stacks and accumulates bound job sets.

Although copy sheet output stacking is described herein, it will be appreciated that there may be extended applications for the present concept, such as for use for a document "job batching" restacker for accumulating original documents and restacking them with separator sheets after sequential document copying or scanning jobs have been completed.

Although an "uphill" stacking system is illustrated herein, with process direction registration at the inside of the stacking system, the concept here could be used with a copier or printer output system with "downhill" [or even horizontal] set registering. In downhill stacking, the elevator track and the registration wall could extend at the opposite angle from the vertical, i.e., inclining towards the machine output as the stacking tray lowers, rather than moving away from the machine as it lowers. That is, moving linearly at approximately the same angle from the vertical, but at an opposite angle thereto.

For optional inverted stacking, the present system may be desirably combined with disk stackers, such as are shown in Xerox Corporation U.S. Pat. Nos. 5,058,880; 5,065,996; 5,114,135; or 5,145,167.

An additional optional feature is a known or suitable tray 20 vibrator 90, which may be used to aid in corner jogging the stacking sheets into the corner defined by end wall 30 and side wall 21.

It is important to note that the stacking system 14 is designed to slide and/or corner-jog into registration the corners of the job sets 13 from which the extended job cover sheets banners 15*a* or 16*a* do not stick out. It is undesirable to attempt to register stack edges from which only job separator cover sheets extend, since the cover sheets edges would tend to buckle. Thus, the tray 20 is extended open and unobstructed on the tray sides from which banners 15*a* and/or 16*a* may extend.

It will be appreciated that while cover sheet 15 or 16 will normally be fed just prior to the first sheet of the job set 13 they are to identify, that alternatively they may be fed just after the job set is printed. Also, if the job sets are being outputted and stacked facedown, another option is to alternatively or additionally print the banners 15*a* or 16*a* on their rear sides so that they will still be visible from the top of (facing up in) the stacking tray.

Facedown output of job set copy sheets is commonly used where the copy sheet output is in forward or 1 to N page order. It may be provided by known printers which print facedown (e.g., with top transfer) or printers having a natural output path sheet inversion, and/or provide an inverter in the machine paper path (as shown in FIG. 1 just below controller 100). [The operation of such inverters is well known, and is described in the above-cited and other patents.]

By selectively using or bypassing such an inverter in the printer [or in the stacker] differently for the cover sheets than for the job copy sheets, the cover sheets may be printed on the same side, yet end up in the final stack with the cover sheets face (printed side) up even though the job sheets are facedown.

In this case or system of stacking the cover sheets printed-side-up in the output tray, where the job set copy sheets are stacked printed-side-down, sufficient job set separation may be optionally provided in some cases by using set stack offsetting [as per the above-cited or other known stacker offsetting systems] for each job. There are at least two different ways in which this may be done. One way is for only the cover sheet itself to be offset by a few centimeters from the rest of a commonly aligned stack of all the job sets, so that the cover sheet printed edge banners are both readily visible and provide for ease of job set separation, as described. I.e., in this case, one edge of only the cover sheets extends from the stack, in a manner similar to that illustrated herein. The cover sheets may be printed and outputted either before or after the face-down job sets they respectively identify. [The operator can be instructed or learn which it is.] However, another way to provide this function is to output a job set of facedown copy sheets and then output a faceup cover sheet for that job set, and then offset the entire next job set and its cover sheet, and so on. I.e., the sorter tray may laterally shift or pivot for offset stacking of the next job set after a faceup cover sheet for that job has been stacked on top of that job. [Alternatively, the stacker can incrementally shift each jobs stacking position in the process direction, as in U.S. Pat. No. 5,128,762 issued Jul. 7, 1992 to H. Muramatsu, et al., which also notes that a 10 mm facsimile job set shift there exposes a printed leading edge margin of the top sheet of each job for identification.] However, it will be appreciated that alternative systems with offsetting require stackers with sequential offsetting drives and mechanisms, and such offsetting systems may also affect the ability to positively edge register the job sets in the stacker.

Different colored paper may also be used for the cover sheets for additional distinctions.

An additional disclosed optional feature here (see especially FIG. 3), is that the sheet output 12 has its exit feed rollers tilted at approximately the same angle as the transverse tilt angle of tray 20 towards side registration wall 21. This can be provided simply by centrally rotating (by that angle) the shafts mounting these exit rollers. This may assist in faster settling of ejected sheets onto the stack in tray 20, making the sheets less likely to miss side wall 21.

Note that a side registration stacking wall (or fingers) 21, or the tray 20 slope, may not be necessary if the printer 10 output path has accurate (consistent) side (or center) sheet registration and the stacker is one which maintains sufficient positive sheet lateral control during sheet entry and stacking.

While the embodiment disclosed herein is preferred, it will be appreciated from this teaching that various alternatives, modifications, variations or improvements therein may be made by those skilled in the art, which are intended to be encompassed by the following claims:

What is claimed is:

1. An improved system for segregating, identifying and separating separate job sets of copy sheets from a commonly stacked output of plural job sets of copy sheets and cover sheets therefor which are sequentially generated by a printer, wherein the copy sheets are sequentially outputted into a sheet stacker in which the plural job sets of copy sheets and their cover sheets may be superposed commonly stacked; and wherein the printer has at least two separate sheet supply trays for the selective feeding of at least two standard sizes of copy sheets for printing; comprising:

control means for selecting which said sheet supply tray will feed copy sheets for a selected job set and for a cover sheet for said job set;

said control means automatically repeatedly feeding and printing a cover sheet for a job set from a said sheet supply tray which is different from the said paper sheet supply tray from which said job set copy sheets are fed;

said sheet stacker being adapted to commonly stack said plural job sets of copy sheets and said respective cover sheets therefor commonly edge aligned on at least two edges, but with at least one edge area of said cover sheets for said job sets extends substantially from at least one edge of said stack of copy sheets of job sets to provide an exposed extended edge banner strip which provides job set segregation and separation by being easily visible and graspable even if said stack of plural job sets is subsequently misaligned;

wherein said sheet supply tray from which said cover sheets are fed contains a differently oriented standard paper size than the sheet supply tray from which said job set copy sheets are fed.

2. The plural job sets segregating system of claim 1, wherein said sheet stacker includes stacking registration means providing sheet stacking edge alignment in said sheet stacker of at least one edge of said job sets other than said at least one edge from which said cover sheets extend.

3. An improved system for segregating, identifying and separating separate job sets of copy sheets from a commonly stacked output of plural job sets of copy sheets and cover sheets therefor which are sequentially generated by a printer, wherein the copy sheets are sequentially outputted into a sheet stacker in which the plural job sets of copy sheets and their cover sheets may be superposed commonly stacked; and wherein the printer has at least two separate sheet supply trays for the selective feeding of at least two standard sizes of copy sheets for printing; comprising:

control means for selecting which said sheet supply tray will feed copy sheets for a selected job set and for a cover sheet for said job set;

said control means automatically repeatedly feeding and printing a cover sheet for a job set from a said sheet supply tray which is different from the said paper sheet supply tray from which said job set copy sheets are fed;

said sheet stacker being adapted to commonly stack said plural job sets of copy sheets and said respective cover sheets therefor commonly edge aligned on at least two edges, but with at least one edge area of said cover sheets for said job sets extends substantially from at least one edge of said stack of copy sheets of job sets to provide an exposed extended edge banner strip which provides job set segregation and separation by being easily visible and graspable even if said stack of plural job sets is subsequently misaligned;

wherein said printer and said control means are further adapted to print job set identifying indicia on said edge area banner of said cover sheet which extends from said job set of copy sheets in said sheet stacker, before said cover sheets are outputted to said stacker.

4. The plural job sets segregating system of claim 2, wherein said sheet supply tray from which said cover sheets are fed contains a larger standard paper size than said sheet supply tray from which said job set copy sheets are fed.

5. The plural job sets segregation system of claim 2, wherein said sheet supply tray from which said cover sheets are fed contains standard legal size sheets, and wherein said sheet supply tray from which said job set copy sheets are fed contains standard letter size sheets.

6. The plural job sets segregating system of claim 3, wherein said job set identifying indicia on said extending edge area banner includes indicia indicating the generator of the directly adjacent job set in the common stack of plural job sets in the sheet stacker.

7. The plural job sets segregating system of claim 3, wherein said cover sheets are at least partially perforated along a tear-off line, which tear-off line is positioned so that said extended edge banner portion can be torn off leaving the remaining portion of the cover sheet with the same dimensions as said job set copy sheets.

8. The plural job sets segregating system of claim 7, wherein said cover sheet is printed in both said removable extending edge portion banner and said remaining portion, and wherein said remaining portion is printed with job set text to form part of said job set.

9. The plural job sets segregating system of claim 7, wherein at least one tear-off mailing label is printed on said extended edge banner portion.

10. The plural job sets segregating system of claim 3, wherein said cover sheets have printed job set identifying indicia, and wherein said job set copy sheets are stacked printed side down in said sheet stacker and wherein said cover sheets are stacked with said printed side up in said sheet stacker.

11. The plural job sets segregating system of claim 3, wherein said stacker is a two-axes corner stacker with a stacking surface and two edge registration surfaces substantially perpendicular said stacking surface for edge alignment of both said job set copy sheets and said cover sheets to said two edge registration surfaces.

12. The plural job sets segregating system of claim 3, wherein said stacker is a two-axes corner stacker with a stacking surface and two edge registration surfaces substantially perpendicular said stacking surface for edge alignment of both said job set copy sheets and said cover sheets to said two edge registration surfaces, and wherein said stacker provides unobstructed stacking space on said stacking surface on at least one of the sides thereof opposite from said two edge registration stacking surfaces for said extended edge areas of said cover sheets.

13. The plural job sets segregating system of claim 3, wherein said stacker is a two-axes corner stacker with a stacking surface and two edge registration surfaces substantially perpendicular said stacking surface for edge alignment of both said job set copy sheets and said cover sheets to said two-edge registration surfaces, and wherein said stacker provides unobstructed stacking space on said stacking surface on at least one of the sides thereof opposite from said two edge registration stacking surfaces for said extended edge areas of said cover sheets, and wherein said stacking surface inclines downwardly from the horizontal on both axes towards both said registration surfaces to provide gravity corner stacking.

* * * * *